US007588022B2

(12) United States Patent
Chang

(10) Patent No.: US 7,588,022 B2
(45) Date of Patent: Sep. 15, 2009

(54) TRIGGER ASSEMBLY WITH A SAFETY DEVICE FOR A CROSSBOW

(75) Inventor: Chu-Wei Chang, Feng-Yuan (TW)

(73) Assignee: Poe Lang Enterprises Co., Ltd., Taichung Hsien (TW)

( * ) Notice: Subject to any disclaimer, the term of this patent is extended or adjusted under 35 U.S.C. 154(b) by 299 days.

(21) Appl. No.: 11/519,955

(22) Filed: Sep. 13, 2006

(65) Prior Publication Data

US 2008/0060629 A1 Mar. 13, 2008

(51) Int. Cl.
*F41B 5/12* (2006.01)

(52) U.S. Cl. ..... 124/25; 124/40

(58) Field of Classification Search ..... 124/25, 124/40

See application file for complete search history.

(56) References Cited

U.S. PATENT DOCUMENTS 4,192,281 A * 3/1980 King ..... 124/25
4,300,271 A * 11/1981 Wohlhaupter ..... 384/7
4,721,092 A * 1/1988 Waiser ..... 124/40
4,867,598 A * 9/1989 Winter, IV ..... 403/381
4,877,008 A * 10/1989 Troubridge ..... 124/25
5,085,200 A * 2/1992 Horton-Corcoran et al. ... 124/25
5,598,829 A * 2/1997 Bednar ..... 124/25
5,649,520 A * 7/1997 Bednar ..... 124/25
6,205,990 B1 * 3/2001 Adkins ..... 124/25
6,425,386 B1 * 7/2002 Adkins ..... 124/31
6,736,123 B1 * 5/2004 Summers et al. ..... 124/25
6,802,304 B1 * 10/2004 Chang ..... 124/25

* cited by examiner

*Primary Examiner*—John Ricci
(74) *Attorney, Agent, or Firm*—Rosenberg, Klein & Lee

(57) ABSTRACT

A trigger assembly has a housing, a trigger, a string holder, a bowstring catch biasing member, a safety pin, a safety lock, a pushing arm, a block, a block biasing member and a string stop. The housing has a mouth. The trigger has a trigger element and an actuating lever combined with the trigger element by dovetailed recess and protrusion. The bowstring catch has a string hook and a leg selectively engaging the hook on the actuating lever. The safety pin is moveably mounted in the housing and is supported on the actuating lever. The safety lock is moveably mounted in the housing and has a push rod. The pushing arm has a protrusion abutting the push rod. The block has a transverse rod selectively engaging the front end of the pushing arm. Accordingly, a trigger assembly with two safety features is provided.

12 Claims, 5 Drawing Sheets

TRIGGER ASSEMBLY WITH A SAFETY DEVICE FOR A CROSSBOW

BACKGROUND OF THE INVENTION

1. Field of the Invention

The present invention relates to a trigger assembly, and more particularly to a trigger assembly with a safety device for a crossbow and providing multiple safety features.

2. Description of Related Art

A crossbow is a weapon that aims and shoots an arrow at a target. A conventional crossbow substantially comprises a stock, a bow, a bowstring and a trigger assembly. The trigger assembly is mounted on the stock and has a catch and a trigger. The catch holds the bowstring in a drawn position and is selectively held in place and released by the trigger. When the trigger is pulled, the drawn bowstring will be released from the catch and the arrow will be shot.

As a weapon, the crossbow has the potential to injure people accidentally. Therefore, a safety device is necessary to keep a crossbow from injuring people unintentionally. However, conventional crossbows usually do not have safety devices, so use of conventional crossbows is hazardous.

Some manufacturers have added a safety device to a conventional crossbow to improve the safety of the crossbow, but the conventional safety device in a crossbow is manual. A crossbow with a safety device is still dangerous when the user forgets to engage the safety device.

To overcome the shortcomings, the present invention provides a trigger assembly for a crossbow to mitigate or obviate the aforementioned problems.

SUMMARY OF THE INVENTION

The main objective of the invention is to provide a trigger assembly for a crossbow, which has a safety device that automatically engages when the bowstring is drawn and connected to the trigger assembly to improve the safety of using the crossbow.

The trigger assembly has a housing, a trigger, a string holder, a bowstring catch biasing member, a safety pin, a safety lock, a pushing arm, a block, a block biasing member and a string stop. The housing has a top, a bottom, a side, a mouth transversely defined in the housing and a slot transversely defined through the side and parallel to the mouth. The trigger is pivotally mounted in the housing and has a trigger element and an actuating lever. The trigger element has a dovetailed recess. The actuating lever is pivotally mounted in the housing and is connected to the trigger. The actuating lever has a hook and a dovetailed protrusion engaging with the dovetailed recess in the trigger element. The bowstring catch is pivotally mounted in the housing and has a string hook and a leg. The string hook is formed on the bowstring catch and corresponds to the mouth in the housing. The leg extends downward from the bowstring catch and selectively engages the hook on the actuating lever. The bowstring catch biasing member is mounted in the housing and has an end connected to the bowstring catch to make the string hook of the bowstring catch retract from the mouth. The safety pin is moveably mounted in the housing and is supported on the actuating lever. The safety lock is moveably mounted in the housing and has a push rod. The push rod extends transversely from the safety lock and into the slot in the housing. The pushing arm is moveably mounted in the housing, corresponds to the mouth in the housing and has a protrusion abutting the push rod on the safety lock. The block is pivotally mounted in the housing and has a transverse rod laterally extending from the block and selectively engaging the front end of the pushing arm. The block biasing member is mounted in the housing and is connected to the block to push the block into the mouth when the transverse rod on the block disengages from the pushing arm. The string stop is pivotally mounted on the housing, extends into the mouth and corresponds to the block.

Other objects, advantages and novel features of the invention will become more apparent from the following detailed description when taken in conjunction with the accompanying drawings.

DETAILED DESCRIPTION OF PREFERRED EMBODIMENT

Figure 1:
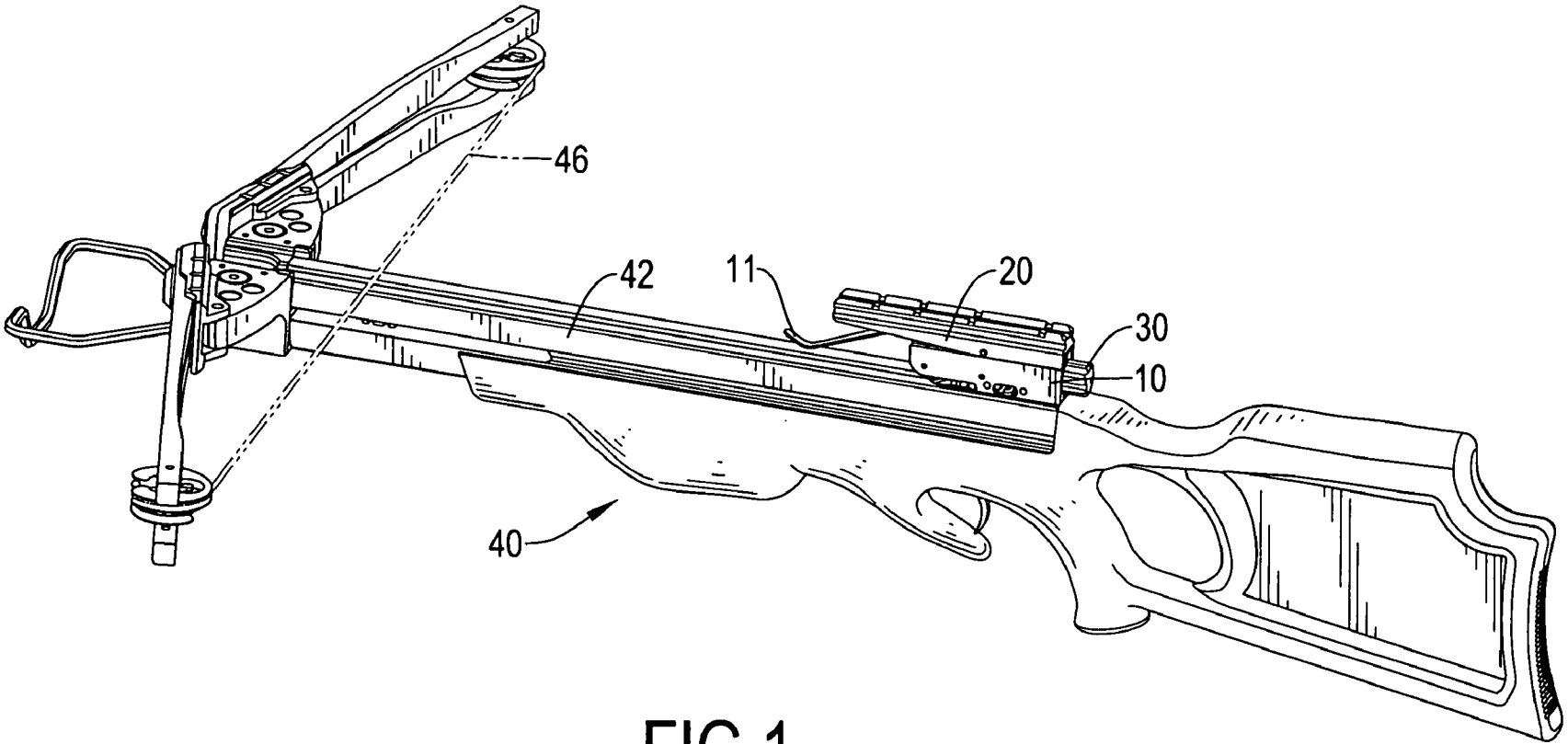
FIG. 1 is a perspective view of a crossbow with a trigger assembly in accordance with the present invention.
Figure 2:
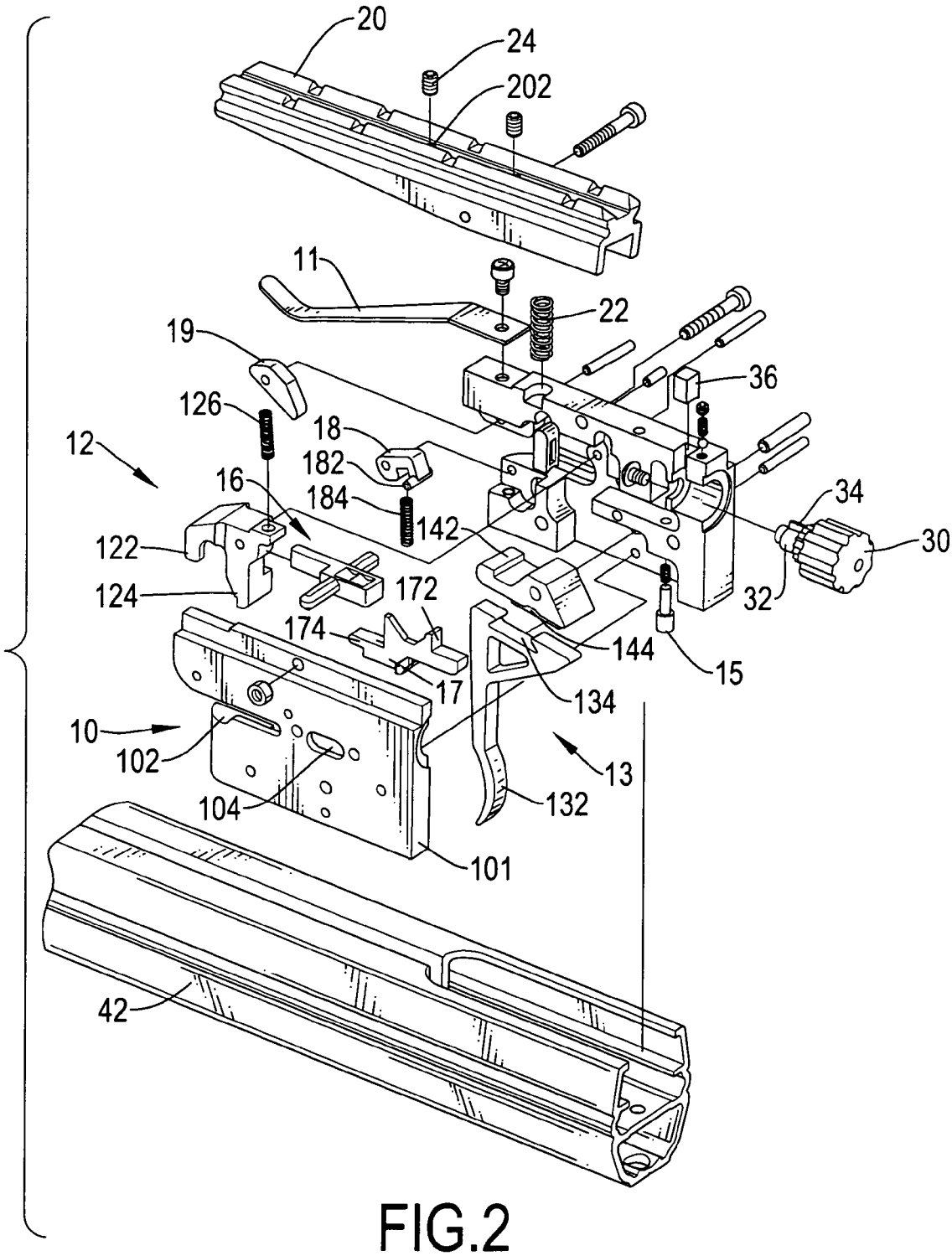
FIG. 2 is an exploded perspective view of the trigger assembly in FIG. 1.
Figure 3:
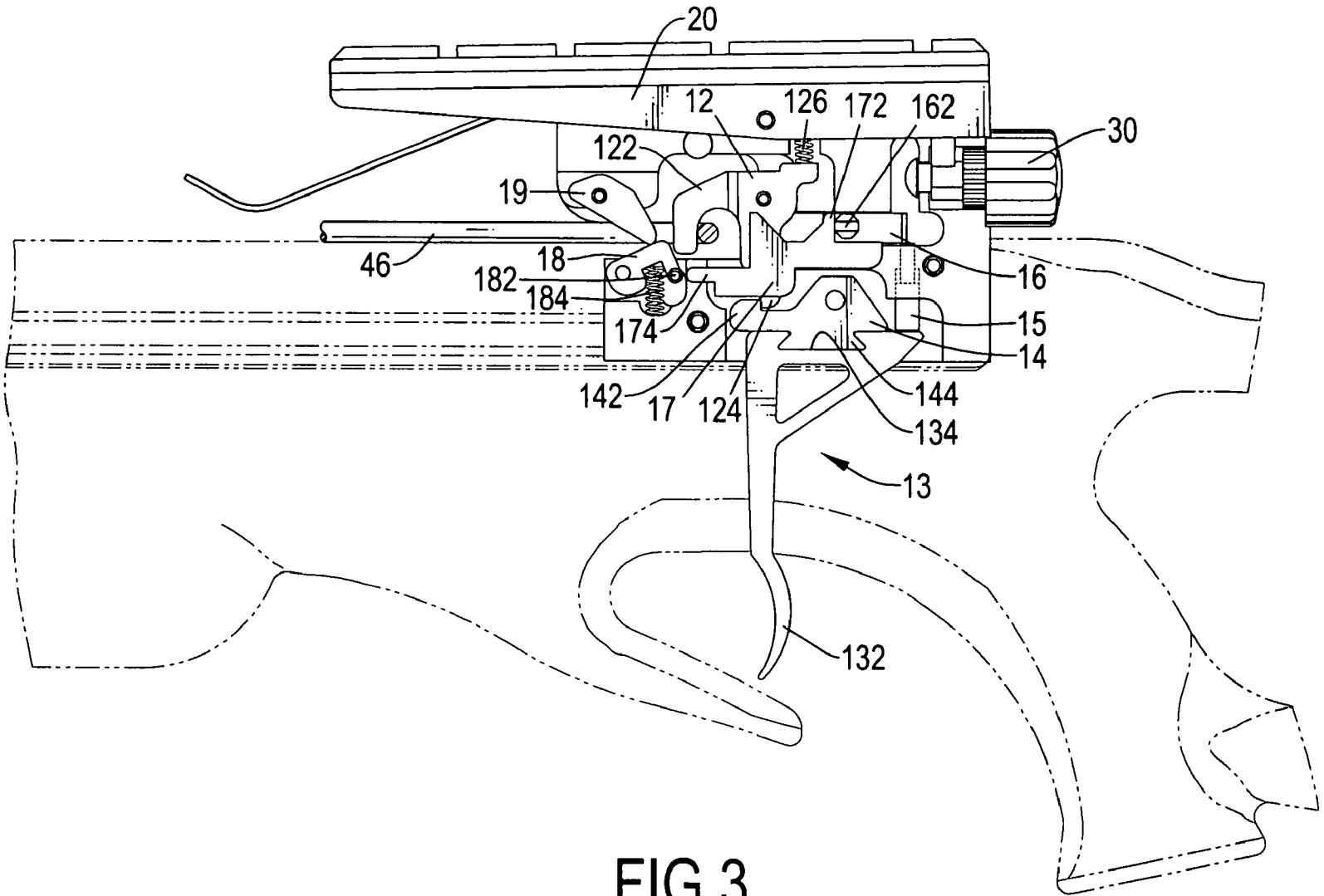
FIG. 3 is a side plan view of the trigger assembly in FIG. 2.

With reference to FIGS. 1 to 3, a trigger assembly in accordance with the present invention for a crossbow (40) having a stock (42) and a transverse bow with a bowstring (46) is mounted on the stock (42) and comprises a housing (10), a trigger (13), a bowstring catch (12), a bowstring catch biasing member (126), a safety pin (15), a safety lock (16), a pushing arm (17), a block (18), a block biasing member (184), a string stop (19), a sight mount (20), an adjusting device and a resilient arrow retainer (11).

The housing (10) is mounted on the stock (42) and has a mouth (102) and a slot (104). The mouth (102) is defined transversely in one end of the housing (10). The slot (104) is defined transversely through the housing and is parallel to the mouth (102). In an optional embodiment, the housing (10) is composed of two half shells (101) attached to each other.

The trigger (13) is mounted pivotally in the housing (10) and has a trigger element (132) and an actuating lever (14). The trigger element (132) protrudes out from the bottom of the housing (10) and has a dovetailed recess (134) defined in the top of the trigger element (132). The actuating lever (14) is mounted pivotally in the housing (10) and is attached to the top of the trigger element (132). The actuating lever (14) has a front end, a bottom and a dovetailed protrusion (144). The front end has a hook (132). The dovetailed protrusion (144) is formed on the bottom and engages with the dovetailed recess (134) in the trigger element (132) to connect the actuating lever (14) with the trigger element (132).

The bowstring catch (12) is mounted pivotally in the housing (10) and has a string hook (122) and a leg (124). The string hook (122) is formed on one end of the catch (12) and corresponds to the mouth (102) in the housing (10). The leg (124) extends downward from the catch (12) and selectively engages the hook (132) on the actuating lever (14).

The bowstring catch biasing member (126) is mounted in the housing (10) between the top of the housing (10) and the bowstring catch (12). When the leg (124) disengages from the hook (132) on the actuating lever (14), the bowstring catch biasing member (126) pivots the string hook (122) of the bowstring catch (12) out of the mouth (102).

The safety pin (15) is mounted moveably in the housing (10) and is supported on the actuating lever (14). When the safety pin (15) is held securely in place, the trigger (13) cannot be pulled.

The safety lock (16) is mounted moveably in the housing (10) and has a push rod (162). One end of the safety lock (16) corresponds to and selectively abuts the safety pin (15). The push rod (162) extends transversely from the safety lock (16) and out of the slot (104) in the housing (10), such that the safety lock (16) can be moved relative to the housing (10) along the slot (104) by means of pulling the push rod (162).

The pushing arm (17) is mounted moveably in the housing (10) and has a bottom, a protrusion (172) and a notch (174). The protrusion (172) is formed on the pushing arm (17) and abuts the push rod (162) on the safety lock (16). The notch (174) is defined in the bottom of the pushing arm (17).

The block (18) is mounted pivotally in the housing (10) at the bottom of the mouth (102) and has a transverse rod (182). The transverse rod (182) extends transversely from the block (18) and is selectively engaged with the pushing arm (17). In an optional embodiment, the transverse rod (182) engages with the notch (174) in the pushing arm (17).

The block biasing member (184) is mounted in the housing (10) between the block (18) and the housing (10) to push the block (18) into the mouth (102) when the transverse rod (182) on the block (18) disengages from the pushing arm (17).

The string stop (19) is mounted pivotally in the housing (10) at the top of the mouth (102), extends into the mouth (102) and corresponds to the block (18). The string stop (19) will extend into the mouth (102) due to the weight of the string stop (19).

Figure 4:
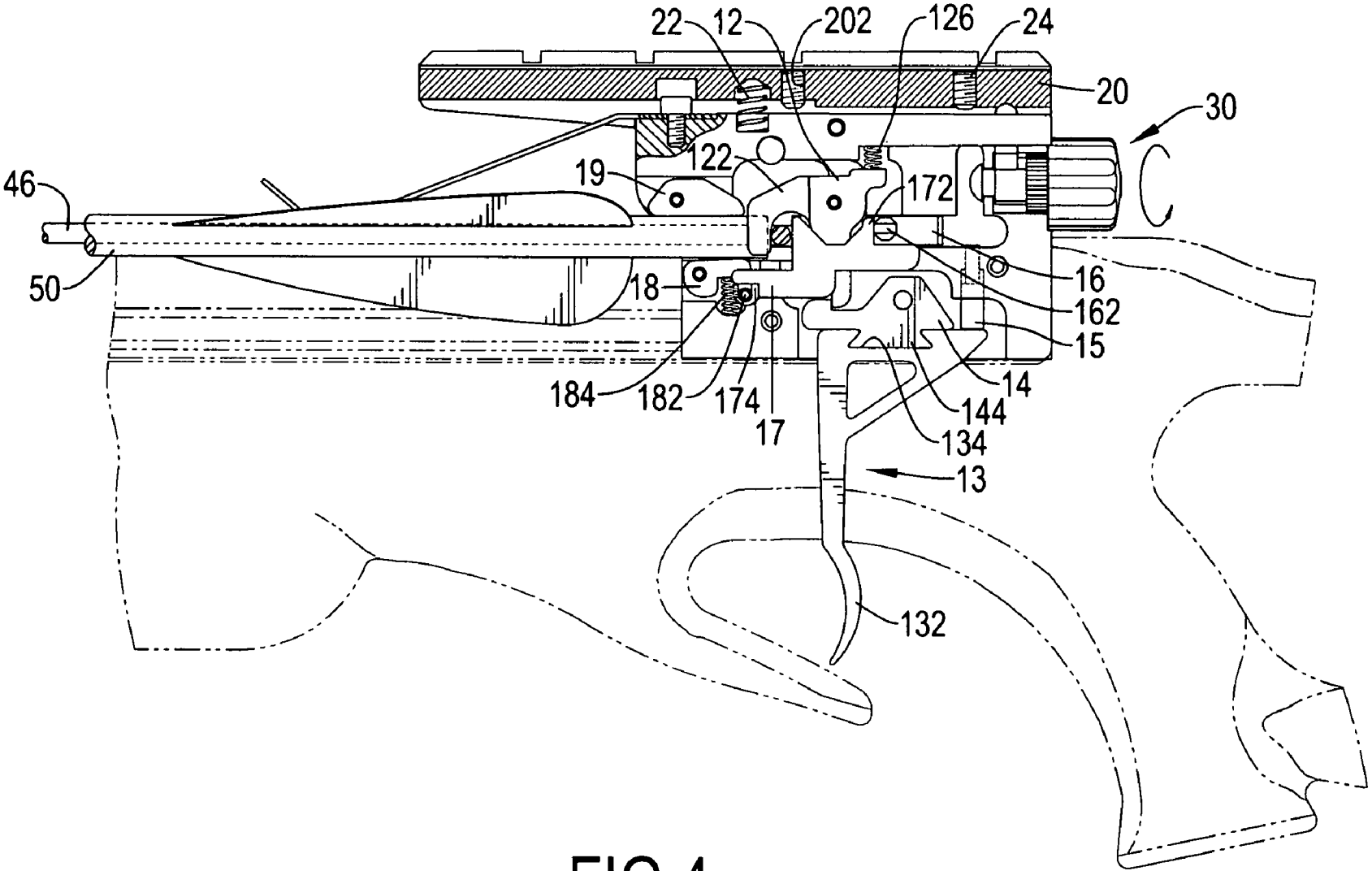
FIG. 4 is an operational side plan view of the trigger assembly in FIG. 3 with an arrow on the stock of the crossbow having pushed the block and the string stop away from the mouth in the housing.

With reference to FIG. 2 to 4, when the bowstring (46) of the crossbow (40) is drawn and enters the mouth (102), the bowstring catch (12) is pushed and pivots relative to the housing (10). The leg (124) on the bowstring catch (12) engages the hook (132) on the actuating lever (14), and the string hook (122) will hold the drawn bowstring (46) on the bowstring catch (12). The pushing arm (17) is moved simultaneously by the bowstring (46), and the protrusion (172) on the pushing arm (17) pushes the safety lock (16) along the slot (104). Accordingly, the safety lock (16) abuts and holds the safety pin (15) in position to keep the safety pin (15) from moving relative to the housing (10). With the safety pin (15) held in place, the trigger (13) is kept from rotating relative to the housing (10), and the drawn bowstring (46) is securely held on the bowstring catch (12) and cannot be released by pulling the trigger (13) so that the trigger assembly is locked automatically.

When the pushing arm (17) is moved relative to the housing (10), the transverse rod (182) on the block (18) will disengage from the notch (174) in the pushing arm (17). The block biasing member (184) will pivot the block (18) relative to the housing (10), and the top of the block (18) extends into the mouth (102). At this time, the transverse rod (182) on the block (18) abuts the pushing arm (17), such that the pushing arm (17) will not move relative to the housing (10). Accordingly, the user cannot push the safety lock (16) backward, such that the trigger assembly cannot be unlocked.

If the user releases the bowstring (46) before the bowstring (46) is engaged by the string hook (122) of the bowstring catch (12), the string stop (19) will stop the released bowstring (46) and keep the bowstring (46) from moving out of the mouth (102). This can keep the drawn bowstring (46) from be unintentionally released before an arrow is inserted into the crossbow (40). The limbs of the crossbow (40) can be kept from being damaged, and the useful life of the crossbow (40) is prolonged.

An arrow (50) inserted into the crossbow will simultaneously push the block (18) and the string stop (19) out of the mouth (10). The transverse rod (182) on the block (18) will leave the position where the transverse rod (182) abuts the pushing arm (17), such that the limitation to the movement of the pushing arm (17) is released. The user can push the safety lock (16) backward to make the safety lock (16) disengage from the safety pin (15). Consequently, the user can pull the trigger (13) to pivot relative to the housing (10). The hook (132) on the actuating lever (14) unhooks the leg (124) on the bowstring catch (12), and the bowstring catch (12) pivots up relative to the housing (10) to release the bowstring (46) from the string hook (122). Consequently, the drawn bowstring (46) is released, and the arrow (50) is fired from the crossbow (40). With the engagement between the recess (134) and the protrusion (144), the combination of the trigger element (132) and the actuating lever (14) is firm. Accordingly, the force for pulling the trigger (13) is efficiently transmitted to pivot the actuating lever (14).

Figure 5:
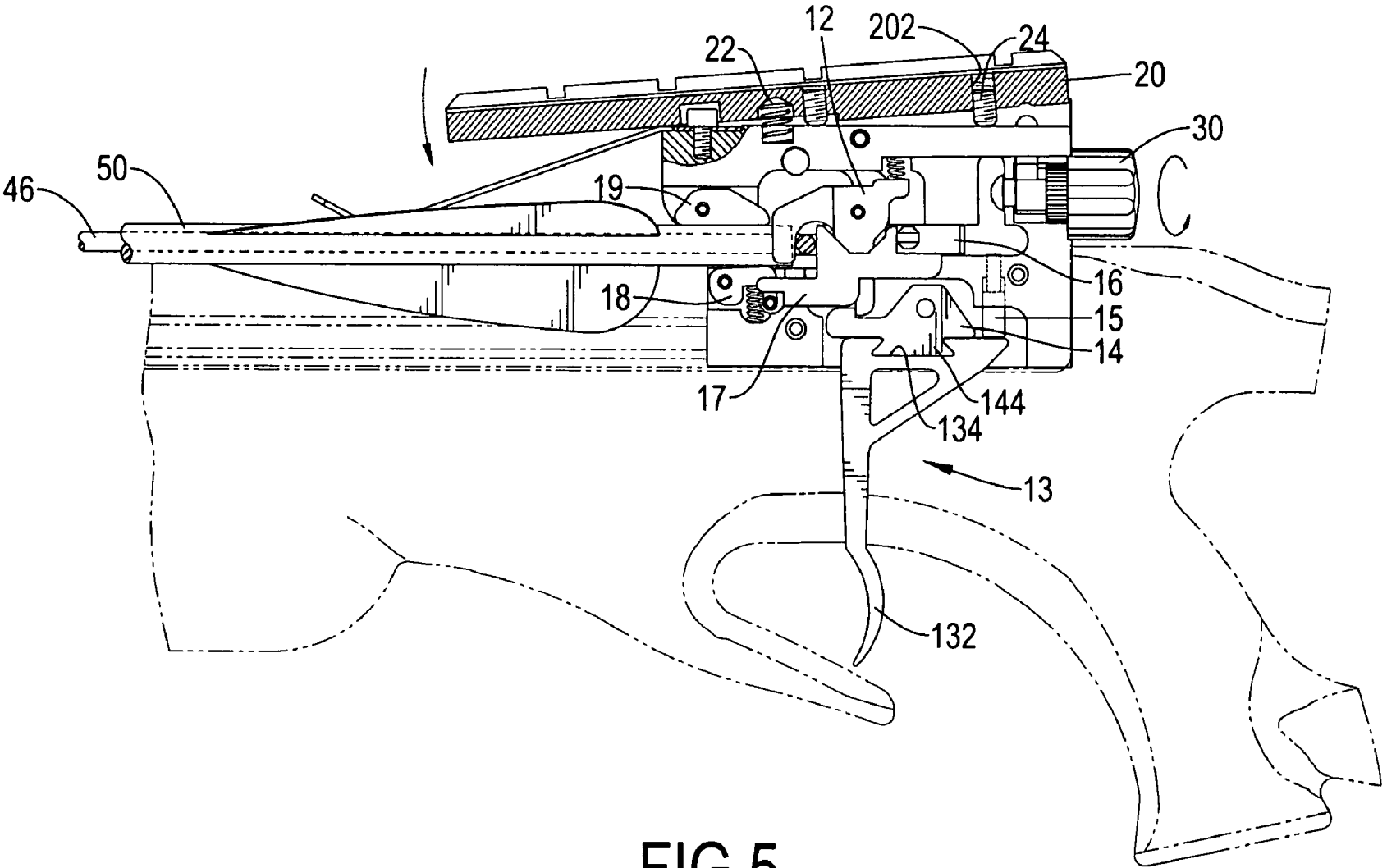
FIG. 5 is an operational side plan view of the sight mount of the trigger assembly in FIG. 3 with the angle of the sight mount adjusted by the adjusting bolts.

With reference to FIGS. 1 to 3, the sight mount (20) is attached to the top of the housing (10) to hold an aiming device such as a scope to assist in aiming the crossbow (40) arrow at a target. The sight mount (20) is attached pivotally to the top of the housing (10) and has a bottom, a pivot point, two threaded holes (202) and two adjusting bolts (24). The threaded holes (202) are defined through the sight mount (20). The adjusting bolts (24) are screwed respectively into the threaded holes (202) and abut against the top of the housing (10). With further reference to FIG. 5, when a first one of the adjusting bolts (24) is released from the position where abutting against the top of the housing, the horizontal level of the sight mount (20) can be adjusted by rotating the second adjusting bolt (24). With the second adjusting bolt (24) pushing against the top of the housing (10), the sight mount (20) will be pivoted relative to the housing (10) to change the horizontal level of the sight mount (20). After the sight mount (20) being adjusted to the desired level, the first adjusting bolt (24) is rotated to abut against the top of the housing (10). Accordingly, the sight mount (20) can be held at the desired horizontal level to fit with different types of aiming device, and the trigger assembly in accordance with the present invention is versatile in use.

The adjusting device is mounted in the housing (10) to adjust the sight mount (20) vertically relative to the housing (10). The adjusting device comprises an adjustment knob (30), a pushing block (36) and a sight mount biasing member (22). The adjustment knob (30) is rotatably mounted in the housing (10) and has a stub (32) and a cam (34). The stub (32) has an outer periphery and rotatably extends into the housing (10). The cam (34) is formed on the outer periphery of the stub (32).

The pushing block (36) is mounted moveably in the housing (10) and has a top and a bottom. The top of the pushing block (36) extends out from the top of the housing (10) and abuts the bottom of the sight mount (20). The bottom of the pushing block (36) is concave and abuts the cam (34) on the adjustment knob (30). The sight mount biasing member (22) is mounted between the top of the housing (10) and the bottom of the sight mount (20).

With rotating the adjustment knob (30), the vertical alignment of an aiming device attached to the sight mount (20) can be adjusted conveniently and easily.

The resilient arrow retainer (11) is mounted on the top of the housing (10) and extends downward to correspond to the mouth (102) in the housing (10). When an arrow (50) is put on the stock (42) of the crossbow (40), the resilient arrow retainer (11) will press against the arrow (50) to make the travel of the arrow (50) on the stock (42) smooth.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A trigger assembly for a crossbow having a stock and a transverse bow with a bowstring, the trigger assembly comprising:

a housing adapted to be mounted on the stock and having a top, a bottom, a side, a mouth with a top and a bottom defined transversely in the housing and a slot defined transversely through the side and parallel to the mouth;

a trigger mounted pivotally in the housing and comprising a trigger element protruding out from the bottom of the housing and having a dovetailed recess defined in a top of the trigger element; and an actuating lever mounted pivotally in the housing, attached to the top of the trigger element and having a hook, a bottom and a dovetailed protrusion formed on the bottom and engaging firmly with the dovetailed recess;

a bowstring catch mounted pivotally in the housing and having a string hook corresponding to the mouth in the housing and a leg extending downward and selectively engaging the hook on the actuating lever;

a bowstring catch biasing member mounted in the housing between the housing and the bowstring catch to pivot the string hook out of to mouth;

a safety pin mounted moveably in to housing and supported on the actuating lever;

a safety lock mounted moveably in the housing, selectively abutting to top of the safety pin and having a push rod extending transversely from the safety lock and out of the slot in the housing;

a pushing arm mounted moveably in the housing and having a protrusion abutting the push rod on the safety lock;

a block mounted pivotally in the housing and having a transverse rod extending transversely from the block and selectively engaged with the pushing arm;

a block biasing member mounted in the housing and connected to the block to push the block into the mouth when the transverse rod on the block disengages from the front end of the pushing arm; and a string stop mounted pivotally in the housing, extending into the mouth and corresponding to the block.

2. The trigger assembly as claimed in claim 1, wherein the housing is composed of two half shells attached to each other.

3. The trigger assembly as claimed in claim 2, wherein the pushing arm further has a notch defined in a bottom of the pushing arm to selectively engage the transverse rod on the block.

4. The trigger assembly as claimed in claim 3, wherein the block is pivotally mounted in the housing at the bottom of the mouth; and the string stop is pivotally mounted in the housing at the top of the mouth.

5. The trigger assembly as claimed in claim 4 further comprising a sight mount mounted on the top of the housing to support an aiming device.

6. The trigger assembly as claimed in claim 5, wherein the sight mount is pivotally attached to the top of the housing and has a bottom, a pivot point, two threaded holes defined through the sight mount and two adjusting bolts screwed respectively into the threaded holes and abutting against the top of the housing; and an adjusting device is mounted in the housing to adjust the sight mount vertically relative to the housing.

7. The trigger assembly as claimed in claim 6 further comprising a resilient arrow retainer mounted on the top of the housing and extending downward to correspond to the mouth in the housing.

8. The trigger assembly as claimed in claim 1, wherein the pushing arm further has a notch defined in a bottom of the pushing arm to selectively engage the transverse rod on the block.

9. The trigger assembly as claimed in claim 1, wherein the block is pivotally mounted in the housing at the bottom of the mouth; and the string stop is pivotally mounted in the housing at the top of the mouth.

10. The trigger assembly as claimed in claim 1 further comprising a sight mount mounted on the top of the housing to support an aiming device.

11. The trigger assembly as claimed in claim 10, wherein the sight mount is pivotally attached to the top of the housing and has a bottom, a pivot point, two threaded holes defined through the sight mount and two adjusting bolts screwed respectively into the threaded holes and abutting against the top of the housing; and an adjusting device is mounted in the housing to adjust the sight mount vertically relative to the housing.

12. The trigger assembly as claimed in claim 1 further comprising a resilient arrow retainer mounted on the top of the housing and extending downward to correspond to the mouth in the housing.

* * * * *